US011123697B2

(12) United States Patent
Hiltbrand

(10) Patent No.: US 11,123,697 B2
(45) Date of Patent: Sep. 21, 2021

(54) ROTARY COMPRESSION MIXER

(71) Applicant: Rory Hiltbrand, Asheville, NC (US)

(72) Inventor: Rory Hiltbrand, Asheville, NC (US)

( * ) Notice: Subject to any disclaimer, the term of this patent is extended or adjusted under 35 U.S.C. 154(b) by 101 days.

(21) Appl. No.: 16/781,919

(22) Filed: Feb. 4, 2020

(65) Prior Publication Data

US 2020/0261863 A1 Aug. 20, 2020

Related U.S. Application Data

(60) Provisional application No. 62/806,532, filed on Feb. 15, 2019.

(51) Int. Cl.
*B01F 3/08* (2006.01)
*B01F 7/00* (2006.01)

(52) U.S. Cl.
CPC ..... *B01F 3/0853* (2013.01); *B01F 3/0807* (2013.01); *B01F 7/007* (2013.01); *B01F 7/0025* (2013.01); *B01F 7/0045* (2013.01)

(58) Field of Classification Search
CPC ..... B01F 2215/0072; B01F 3/0478; B01F 3/0807; B01F 3/0853; B01F 5/22; B01F 7/0025; B01F 7/0045; B01F 7/007
See application file for complete search history.

(56) References Cited

U.S. PATENT DOCUMENTS 2,219,571 A * 10/1940 Cowies ..... B01F 7/0045 366/316
2,464,588 A * 3/1949 Knudsen ..... B01F 7/00466 241/46.17
2,626,135 A * 1/1953 Serner ..... B01F 7/0045 366/316
2,692,127 A * 10/1954 Conn ..... B01F 7/00475 416/181
3,100,628 A * 8/1963 Norris, Jr. ..... B01F 7/0045 366/317
3,222,038 A * 12/1965 Asheraft ..... B01F 7/165 366/289
3,273,865 A * 9/1966 White ..... C02F 3/16 366/307
3,322,401 A * 5/1967 Mersch ..... B01F 7/00466 366/326.1
3,326,532 A * 6/1967 Lodge ..... B01F 7/1625 366/286
3,376,024 A * 4/1968 Beechler ..... B01F 7/00466 416/183
3,462,131 A * 8/1969 Hill ..... B01F 7/00641 366/176.1
3,464,636 A * 9/1969 Byers ..... B02C 17/16 241/21
3,486,741 A * 12/1969 Midgette ..... C09B 67/0091 366/316

(Continued)

*Primary Examiner* — Tony G Soohoo
(74) *Attorney, Agent, or Firm* — Christopher Pilling; Johan Eide; My Patent Guys

(57) ABSTRACT

The present invention is directed towards a rotary compression mixer for providing the user with a rotary compression mixer wherein the user can directly manipulate the resultant electrical charge imbalances or coherence domains of a liquid. The motor of the rotary compression mixer recirculates liquids and gases within the liquid container, while simultaneously compressing the liquid while moving the gases and liquids centrifugally outward towards the liquid container.

9 Claims, 3 Drawing Sheets

(56) References Cited

U.S. PATENT DOCUMENTS 3,606,577 A * 9/1971 Conn ..... B01F 7/00475 416/181
3,630,636 A * 12/1971 Hill ..... B01F 7/00466 416/199
3,690,621 A * 9/1972 Tanaka ..... B01F 7/00241 366/265
4,171,166 A * 10/1979 Trowbridge ..... B01F 7/0045 366/316
4,176,797 A * 12/1979 Kemp ..... B01F 7/0045 241/30
4,451,155 A * 5/1984 Weber ..... B01F 7/0045 366/265
4,483,624 A * 11/1984 Bacon, Jr. ..... B01F 7/169 209/168
4,604,109 A * 8/1986 Koslow ..... B01D 19/0047 95/248
4,813,787 A * 3/1989 Conn ..... B01F 7/00458 366/296
5,226,727 A * 7/1993 Reichner ..... B01F 3/04539 366/170.3
6,132,080 A * 10/2000 Gurth ..... B01F 7/00241 366/286
6,280,078 B1 * 8/2001 Lewis ..... B01F 3/04539 366/316
6,585,169 B2 * 7/2003 Andersson ..... B01J 2/04 239/217
6,857,774 B2 * 2/2005 Kozyuk ..... B01F 3/0807 366/263
7,316,502 B2 * 1/2008 Freeman ..... B01F 7/00041 366/316
8,026,402 B2 * 9/2011 Hassan ..... B01F 7/00766 585/270
10,662,094 B2 * 5/2020 Burnett ..... B01F 5/0478
2004/0085856 A1 * 5/2004 Murosako ..... B01F 7/0045 366/262
2006/0233044 A1 * 10/2006 Freeman ..... B01F 7/00041 366/316
2020/0261863 A1 * 8/2020 Hiltbrand ..... B01F 3/0807

* cited by examiner

ROTARY COMPRESSION MIXER

CROSS-REFERENCE TO RELATED APPLICATIONS

The present invention claims priority to provisional application Ser. No. 62/806,523 entitled "Rotary Compression Mixer" filed Feb. 15, 2019, the disclosure of which is hereby incorporated in its entirety at least by reference.

BACKGROUND

1. Field of the Invention

The present invention relates to a rotary compression mixer for use in liquid emulsification.

2. Description of Related Art

The electromagnetism of water and electrical imbalances within water and other liquid molecules are well known in the sciences. The differences and electrical imbalances between water molecules at a molecular level are often referred to as a coherence domain or a "CD". As water molecules are subject to biological and environmental interactions the coherence domain of a water molecule can be altered greatly, thereby changing observable and non-observable characteristic of the liquid or of water, such as changes in viscosity and surface tension. Manipulating the coherence domain of water or a liquid can lead to many different benefits desired by the user. Historically, there have been limited ways to induce changes in coherence domains or electrical imbalances of water and other liquids on a controlled and mass scale. A device is needed to directly control the electrical imbalances of liquids at a consumer product level, wherein the consumer or the user can directly manipulate the coherence domain of the liquid within the device.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The present invention solves the problems stated above by providing the user with a device wherein the user can directly manipulate the resultant electrical charge imbalances or coherence domains of a liquid. The motor of the rotary compression mixer recirculates liquids and gases within the liquid container, while simultaneously compressing the liquid and gases while moving them centrifugally outward towards the liquid container.

Another objective of the invention is to reorganize the molecular structure of the contained fluids and gaseous substances. With the rotary compression mixer, water clusters are broken up allowing for more bioavailability of water molecules. This has implications for human health. Another benefit of the rotary compression mixer is the creation of more potent solutions or liquid beverages. For example, the present invention can also be applied to common liquid beverages including teas, coffees, tinctures, etc.

In order to do so, a rotary compression mixer having a support structure including a base member and a support arm is provided. Within the rotary compression mixer, a liquid container is arranged having a top outer container and a lower outer container. Next, a rotary shaft protrudes within the top outer container of the liquid container through a first concentric opening. A suction member having a hollow core is then adjoined to the bottom mounting plate of the rotary shaft with a first plurality of fasteners. A first rippled plate arranged between the rotary shaft and the suction member and a second rippled plate is arranged below the first rippled plate. The rotary compression mixer is driven by a motor and a power supply adjoined to the support arm and the rotary shaft is adjoined to the motor.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE FIGURES

The detailed description of some embodiments of the invention is made below with reference to the accompanying figures, wherein like numerals represent corresponding parts of the figures.

The novel features of the disclosure are set forth with particularity in the appended claims. A better understanding of the features and advantages of the present disclosure will be obtained by reference to the following detailed description that sets forth illustrative embodiments, in which the principles of the disclosure are utilized, and the accompanying drawings of which:

DETAILED DESCRIPTION OF CERTAIN EMBODIMENTS

While preferred embodiments of the present disclosure have been shown and described herein, it will be obvious to those skilled in the art that such embodiments are provided by way of example only. Numerous variations, changes, and substitutions will now occur to those skilled in the art without departing from the disclosure. It should be understood that various alternatives to the embodiments of the disclosure described herein may be employed in practicing the disclosure.

Figure 1:
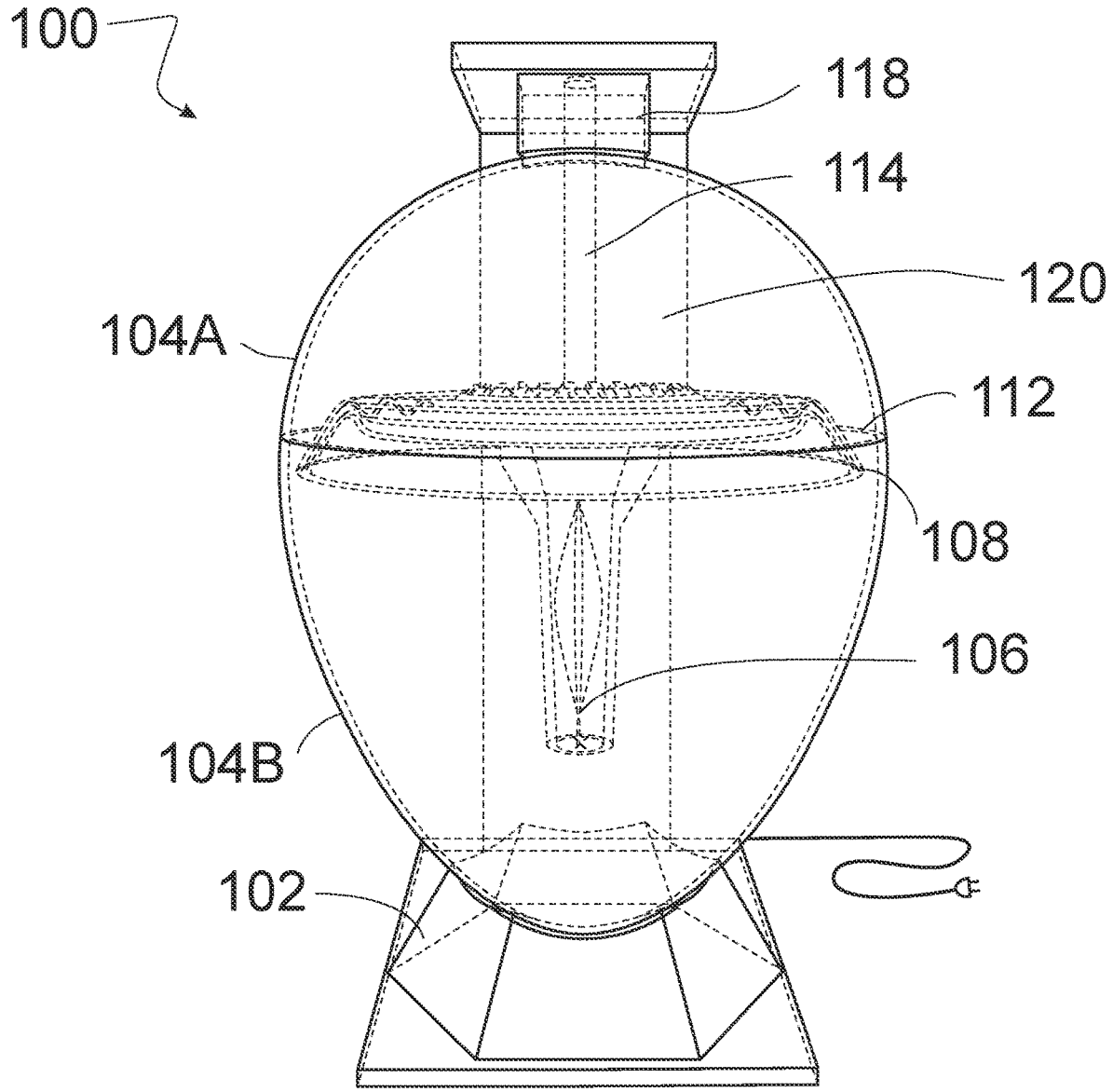
FIG. 1 shows an exemplary front view of one embodiment of the rotary compression mixer according to an embodiment of the present invention.
Figure 2:
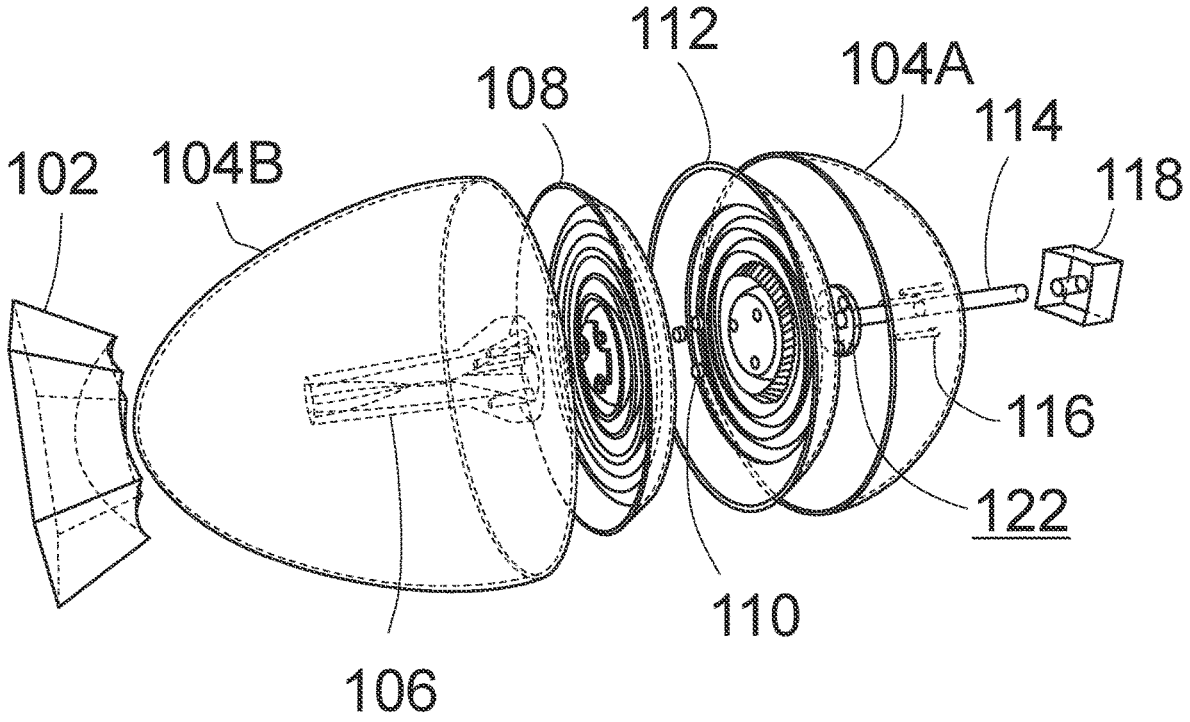
FIG. 2 shows an exemplary perspective exploded view of one embodiment of the rotary compression mixer according to an embodiment of the present invention.
Figure 3:
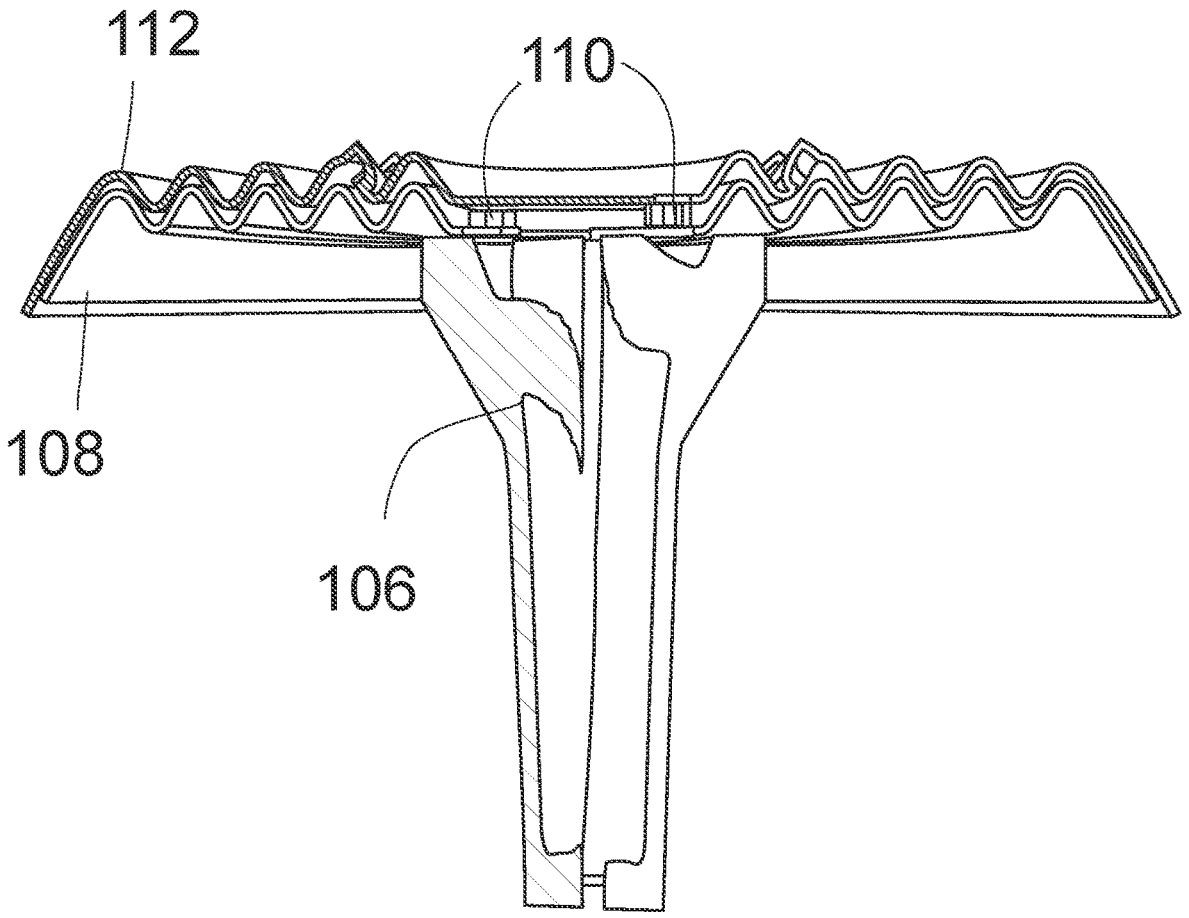
FIG. 3 shows an exemplary cross-sectional view of one embodiment of the first rippled plate and the second rippled plate of the rotary compression mixer according to an embodiment of the present invention, the other components of the rotary mixer have been removed for clarity.

As shown in FIG. 1-3, an exemplary embodiment of a rotary compression mixer 100 is shown. The rotary compression mixer 100 comprises a support structure having a base member 102 and a support arm 120. Arranged between the base member 102 and the support arm 120 is a liquid container having a top outer container 104A and a lower outer container 104B. In some embodiments, the top outer container 104A and the lower container create an airtight seal. In alternative embodiments, the top outer container 104A and the lower container create a connection that is open to ambient airflow. The top outer container 104A further comprises a first concentric opening. Next, a rotary shaft 114 having a proximal end and a distal end includes a bottom mounting plate 122 adjoined to the distal end of the rotary shaft 114, wherein the rotary shaft 114 is configured to protrude within the top outer container 104A of the liquid container through the first concentric opening. The support arm 120, the base member 102, and the rotary shaft 114 aid in keeping the liquid container upright and level within the support structure of the rotary compression mixer 100. Below the bottom mounting plate 122 of the rotary shaft 114 is a suction member 106 having a hollow core consisting of a distal end and a proximal end. In some embodiments, the hollow core of the suction member 106 further comprises a plurality of angled blades, wherein the plurality of angled blades may be spaced radially along an internal surface of the hollow core at a predetermined distance. In some embodiments, the series of angled blades may be positioned along a logarithmic spiral pattern. In some embodiments, the proximal end of the suction member 106 is adjoined to the bottom mounting plate 122 of the rotary shaft 114 with a first plurality of fasteners 116. Between the bottom mounting plate 122 and the proximal end of the suction member 106 rests a first rippled plate 112. In some embodiments, the first rippled plate 112 further comprises a plurality of radial fluted slots protruding through the first rippled plate 112. Next, in some embodiments, a second rippled plate 108 is arranged below the first rippled plate 112 and arranged between the bottom mounting plate 122 and the proximal end of the suction member 106. In some embodiments, a first plurality of spacers 110 are located concentrically to the first plurality of fasteners 116 is arranged between the first rippled plate 112 and the second rippled plate. A motor 118 is adjoined to the support arm 120 of the support structure, wherein the rotary shaft 114 is adjoined to the motor 118.

The rotary compression mixer 100 is configured to hold a fluid within the liquid container, such that the fluid may be infused with microbubbles. This is shown to increase an exclusion zone portion of water within the fluid. The exclusion zone of the liquid or water creates a hexagonal lattice of $H_30_2$ molecules which creates a charge differential effectively storing potential energy. Thereby, for example, altering the potency of common liquid beverages or altering the growth rate of biological members.

In some embodiments, the rotary compression device is made of at least one material of a material set consisting of: a wood material, a plastic material, a metal material, a rubber material, a polymer material, a fiberglass material, and a composite material. The plastic material used to make the rotary compression mixer 100 can be one of the following plastic material types, by way of non-limiting example, a glass material, a composite material, a borosilicate glass material, a polyethylene terephthalate (PETE or PET) plastic, a polyethylene (PE) plastic, a polyvinyl chloride (PVC) plastic, a polypropylene (PP) plastic, a polystyrene (PS) plastic, a polylactic acid (PLA) plastic, a thermoplastic, a polycarbonate (PC) plastic, an acrylic (PMMA) plastic, an acetal plastic, a nylon plastic, and an acrylonitrile butadiene styrene (ABS) plastic. In some embodiments, the first plurality of fasteners 116 is at least one member of an attachment set consisting of: a snap-fit, an adhesive, a threaded connection, a magnet, a press-fit, a fastener, a spring, a clamp, a clip, a heat-shrink material, and an elastic member.

In some embodiments, the motor 118 of the rotary compression device be further coupled to the power supply. The power supply in some embodiments may be, by way of non-limiting example, comprise at least one member of a power set consisting of an internal combustion motor 118, an electrical power bank, a battery, a brushless motor 118, an electrical outlet and a brushed motor 118. The motor 118 may be in some embodiments connected by gear, a plurality of gears, chain, any shape of belt or hub motor 118.

During use, fluid is lifted up via suction member 106 between the first rippled plate 112 and the second rippled plate 108, then radially outward. Air enters the first rippled plate 112 via fluted slots and mixes with the fluid moving radially outward. The fluid is pushed outward and rotates down to the bottom of the liquid container. In other embodiments, the rotary compression device is used as an improved wine aeration device. In yet other embodiments, the rotary compression mixer 100 is a household device for the restructuring of water molecules. The base member 102 designed to rest upon a flat surface such as a countertop. In some embodiments, the rotary compression mixer 100 is scaled or resized to be a commercial mixer, wherein the restructured water molecules become more effective at absorbing solutes to create more potent coffee, teas, tinctures, etc. In some embodiments, the rotary compression mixer 100 is incorporated into plumbing systems for benefits to commercial, residential or government buildings.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated and can be made without departing from the spirit and scope of the invention. For instance, in some embodiments, a near-infrared light may be provided, wherein the infrared light is configured to increase the production of exclusion zone (EZ) water.

All references throughout this application, for example, patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

Unless otherwise defined, all technical terms used herein have the same meaning as commonly understood by one of ordinary skill in the art to which this disclosure belongs.

As used herein, the singular forms "a," "an," and "the" include plural references unless the context clearly dictates otherwise. Any reference to "or" herein is intended to encompass "and/or" unless otherwise stated.

As used herein, the term "about" refers to an amount that is near the stated amount by about 0%, 5%, or 10%, including increments therein.

Unless otherwise defined, all technical terms used herein have the same meaning as commonly understood by one of ordinary skill in the art to which this disclosure belongs.

Any element in a claim that does not explicitly state "means for" performing a specified function, or "step for" performing a specified function, is not to be interpreted as a "means" or "step" clause as specified in 35 U.S.C. § 112, ¶6. In particular, any use of"step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A rotary compression mixer for use in liquid emulsification, the rotary compression mixer comprising:

a support structure having a base member and a support arm;

a liquid container having a top outer container and a lower outer container, wherein the top outer container further comprises a first concentric opening, wherein the liquid container is arranged between the base member and the support arm;

a rotary shaft having a proximal end and a distal end, the rotary shaft having a bottom mounting plate adjoined to the distal end of the rotary shaft; wherein the rotary shaft protrudes within the top outer container of the liquid container through the first concentric opening;

a suction member having a hollow core and having a distal end and a proximal end; wherein the proximal end of the suction member is adjoined to the bottom mounting plate of the rotary shaft with a first plurality of fasteners;

a first rippled plate arranged between the bottom mounting plate and the proximal end of the suction member; wherein the first rippled plate further comprises a plurality of radial fluted slots protruding through the first rippled plate;

a second rippled plate arranged below the first rippled plate and arranged between the bottom mounting plate and the proximal end of the suction member;

a first plurality of spacers concentric to the first plurality of fasteners and arranged between the first rippled plate and the second rippled plate; and, a motor adjoined to the support arm, wherein the rotary shaft is adjoined to the motor.

2. The rotary compression mixer of claim 1, wherein the hollow core of the suction member further comprises a plurality of angled blades.

3. The rotary compression mixer of claim 2, wherein the plurality of angled blades are arranged along a logarithmic spiral pattern.

4. A rotary compression mixer for use in liquid emulsification, the rotary compression mixer comprising:

a support structure having a base member and a support arm;

a liquid container arranged between the base member and the support arm;

a rotary shaft protrudes within a portion of the liquid container;

a suction member having a hollow core;

a first rippled plate having a plurality of radial fluted slots protruding through the first rippled plate;

a second rippled plate arranged below the first rippled plate;

a motor adjoined to the support arm, wherein the rotary shaft is adjoined to the motor.

5. The rotary compression mixer of claim 4, further comprising a first plurality of spacers arranged between the first rippled plate and the second rippled plate.

6. The rotary compression mixer of claim 4, wherein the liquid container includes a top outer container and a lower outer container, wherein the top container further comprises a first concentric opening.

7. The rotary compression mixer of claim 6, wherein the rotary shaft protrudes within the top outer container of the liquid container through the first concentric opening.

8. The rotary compression mixer of claim 4, wherein the hollow core of the suction member further comprises a plurality of angled blades.

9. The rotary compression mixer of claim 8, wherein the plurality of angled blades are arranged along a logarithmic spiral pattern.

* * * * *